US011577869B2

(12) United States Patent
Mayer et al.

(10) Patent No.: US 11,577,869 B2
(45) Date of Patent: Feb. 14, 2023

(54) APPARATUS FOR PACKAGING OBJECTS

(71) Applicant: Weber Maschinenbau GmbH Breidenbach, Breidenbach (DE)

(72) Inventors: Josef Mayer, Memmingerberg (DE); Jörg Schmeiser, Wiggensbach (DE)

(73) Assignee: WEBER MASCHINENBAU GMBH BREIDENBACH, Breidenbach (DE)

( * ) Notice: Subject to any disclaimer, the term of this patent is extended or adjusted under 35 U.S.C. 154(b) by 182 days.

(21) Appl. No.: 16/232,617

(22) Filed: Jan. 30, 2019

(65) Prior Publication Data

US 2019/0308760 A1 Oct. 10, 2019

(51) Int. Cl.
*B65B 41/14* (2006.01)
*B65B 9/04* (2006.01)
(Continued)

(52) U.S. Cl.
CPC ..... *B65B 41/14* (2013.01); *B65B 9/04* (2013.01); *B65B 25/06* (2013.01); *B65B 41/12* (2013.01);
(Continued)

(58) Field of Classification Search
CPC ..... B65H 23/1825; B65H 23/185; B65H 23/005; B65H 23/18; B65H 2555/24;
(Continued)

(56) References Cited

U.S. PATENT DOCUMENTS 3,762,125 A * 10/1973 Prena ..... B65B 47/04 53/51
3,979,080 A * 9/1976 Herbert ..... B21B 37/46 242/563.2
(Continued)

FOREIGN PATENT DOCUMENTS

CN 104670946 A 6/2015
DE 3926413 A1 2/1991
(Continued)

OTHER PUBLICATIONS

Communication from German Patent Office for Application No. 102017131417.2 dated Jul. 10, 2018, 4 pages.
European Partial Search Report for European Application No. 18206147.3 dated Mar. 6, 2019, 2 pages.
Communication received from the European Patent Office for related European Application No. 18206147.3; dated Aug. 23, 2019; 17 pages.

*Primary Examiner* — Thomas M Wittenschlaeger
(74) *Attorney, Agent, or Firm* — Dickinson Wright PLLC

(57) ABSTRACT

A packaging apparatus for packaging objects, in particular for packaging food portions, having a conveying device (10) for transporting a continuous web of a first packaging material (12), in particular of a bottom film, in a transport direction (TR); and having a feed device (14) for feeding a continuous web of a second packaging material (16), in particular of a top film, in the transport direction (TR), wherein the conveying device (10) comprises a first reception shaft (18) for receiving a first supply roll (20) of the first packaging material (12) and the feed device (14) comprises a second reception shaft (22) for receiving a second supply roll (24) of the second packaging material (16); wherein the first reception shaft (18) can be driven by means of a first drive motor (26) to carry out a rotational movement; and/or wherein the second reception shaft (22) can be driven by means of a second drive motor (28) to carry out a rotational movement, with the first and/or second drive motor (26, 28) in particular being a servomotor or servomotors.

2 Claims, 1 Drawing Sheet

(51) Int. Cl.

| | |
|---|---|
| ***B65B 41/16*** | (2006.01) |
| ***B65B 41/18*** | (2006.01) |
| ***B65D 85/38*** | (2006.01) |
| ***B65H 23/18*** | (2006.01) |
| ***B65B 57/04*** | (2006.01) |
| ***B65B 25/06*** | (2006.01) |
| ***B65H 23/00*** | (2006.01) |
| ***B65B 41/12*** | (2006.01) |
| *B65B 63/00* | (2006.01) |
| *B65B 47/00* | (2006.01) |

(52) U.S. Cl.
CPC ..... *B65B 41/16* (2013.01); *B65B 41/18* (2013.01); *B65B 57/04* (2013.01); *B65D 85/38* (2013.01); *B65H 23/005* (2013.01); *B65H 23/18* (2013.01); *B65B 47/00* (2013.01); *B65B 63/005* (2013.01); *B65H 2801/81* (2013.01)

(58) Field of Classification Search
CPC ..... B65H 2701/1944; B65H 2801/81; B65B 57/04; B65B 9/04; B65B 25/06; B65B 41/14; B65B 41/16; B65B 41/18; B65B 41/12; B65B 47/00; B65B 63/005; B65D 85/38
See application file for complete search history.

(56) References Cited

U.S. PATENT DOCUMENTS

| | | | | | |
|---|---|---|---|---|---|
| 4,278,213 | A * | 7/1981 | Rubruck | B65H 23/1825 | 242/420.2 |
| 4,574,566 | A * | 3/1986 | Eaves | B65B 9/067 | 53/450 |
| 4,868,759 | A * | 9/1989 | Ross | B65B 41/18 | 700/125 |
| 4,898,985 | A | 2/1990 | Ito et al. | | |
| 5,010,712 | A * | 4/1991 | Odenthal | B65B 5/04 | 53/207 |
| 5,067,307 | A * | 11/1991 | Francioni | B65B 57/06 | 53/450 |
| 5,170,611 | A * | 12/1992 | Buchko | B26D 5/00 | 226/44 |
| 5,359,525 | A * | 10/1994 | Weyenberg | A61F 13/15772 | 700/124 |
| 5,802,804 | A * | 9/1998 | Esposti | B65B 9/045 | 53/246 |
| 6,021,629 | A * | 2/2000 | Sterner, Sr. | B29C 66/24244 | 53/471 |
| 6,033,502 | A * | 3/2000 | Coenen | A61F 13/15772 | 156/229 |
| 6,340,130 | B2 * | 1/2002 | Wild | B65H 23/1825 | 242/420.6 |
| 6,820,399 | B2 * | 11/2004 | Send | B65B 41/18 | 493/10 |
| 7,293,683 | B2 * | 11/2007 | Natterer | B65B 41/14 | 226/170 |
| 7,458,538 | B2 * | 12/2008 | Betti | B65H 16/10 | 242/420.1 |
| 7,955,456 | B2 * | 6/2011 | Fischer | B65B 61/025 | 156/64 |
| 8,474,226 | B2 * | 7/2013 | Izquierdo | B65B 61/08 | 53/389.2 |
| 10,065,755 | B2 * | 9/2018 | Palumbo | B65B 47/04 | |
| 10,703,118 | B2 * | 7/2020 | Hayashi | B41J 15/16 | |
| 2007/0170297 | A1 * | 7/2007 | Send | B65H 16/04 | 242/421 |
| 2007/0170299 | A1 * | 7/2007 | Ritter | B65H 16/103 | 242/533.6 |
| 2012/0292422 | A1 * | 11/2012 | Bonneville | B65H 23/185 | 242/416 |
| 2015/0096263 | A1 * | 4/2015 | Ehrmann | B65B 9/04 | 53/411 |
| 2016/0183474 | A1 * | 6/2016 | Thoreson | B65B 11/58 | 53/399 |
| 2016/0187484 | A1 * | 6/2016 | Bloomfield | B65H 23/1955 | 250/341.8 |
| 2017/0152120 | A1 * | 6/2017 | Montoya | B65H 19/126 | |
| 2017/0267001 | A1 * | 9/2017 | Hayashi | B65H 23/1825 | |
| 2017/0327257 | A1 * | 11/2017 | Sabato | B65B 51/14 | |
| 2018/0194505 | A1 * | 7/2018 | Amano | B65B 61/025 | |
| 2019/0127101 | A1 * | 5/2019 | Merk | B65B 59/02 | |

FOREIGN PATENT DOCUMENTS

| | | | |
|---|---|---|---|
| DE | 29722682 | U1 | 4/1999 |
| DE | 19748715 | A1 | 5/1999 |
| DE | 69510374 | T2 | 2/2000 |
| DE | 10020143 | A1 | 11/2000 |
| DE | 10065389 | A1 | 5/2002 |
| DE | 20307345 | U1 | 7/2003 |
| DE | 69721591 | T2 | 3/2004 |
| DE | 10326727 | B3 | 8/2004 |
| DE | 102005044537 | C5 | 10/2006 |
| DE | 60213294 | T2 | 7/2007 |
| DE | 102006045292 | A1 | 4/2008 |
| DE | 202017102548 | U1 | 5/2017 |
| EP | 2514697 | A2 | 10/2012 |
| JP | H05338883 | A | 12/1993 |
| WO | 2004077913 | A2 | 9/2004 |
| WO | 2016087169 | A1 | 6/2016 |

* cited by examiner

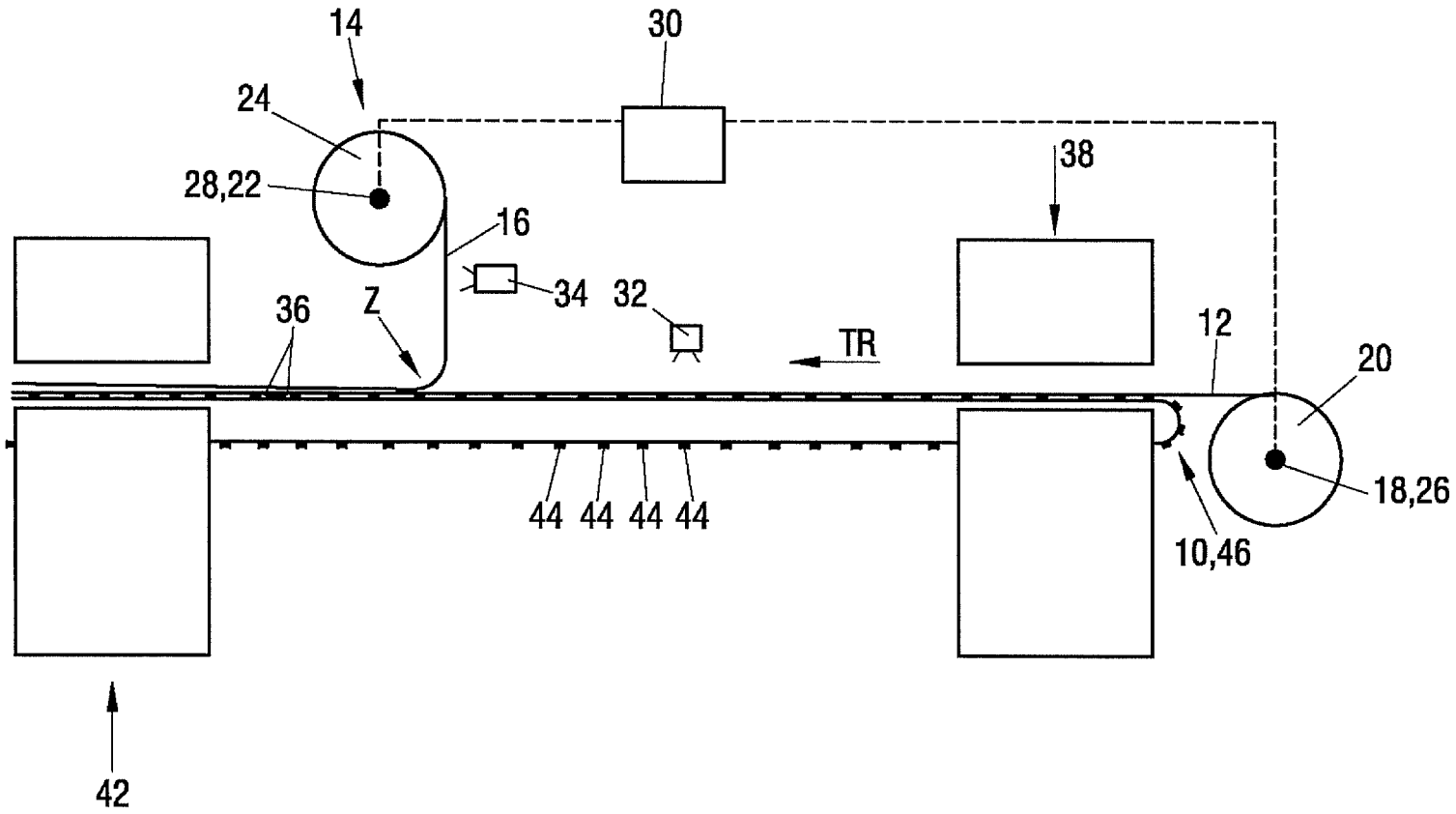
20
18,26
12
10,46
38
TR
30
32
34
16
14
Z
24
28,22
36
44
44
44
44
42

APPARATUS FOR PACKAGING OBJECTS

CROSS-REFERENCES TO RELATED APPLICATIONS

This patent application claims the priority of German Application No. 102017131417.2, filed Dec. 29, 2017, which are incorporated herein by reference in its entirety.

The present invention relates to a packaging apparatus for packaging objects, in particular for packaging food portions, having a conveying device for transporting a continuous web of a first packaging material, in particular of a bottom film, in a transport direction; and having a feed device for feeding a continuous web of a second packaging material, in particular of a top film, in the transport direction, wherein the conveying device comprises a first reception shaft for receiving a first supply roll of the first packaging material and the feed device comprises a second reception shaft for receiving a second supply roll of the second packaging material.

In the food industry, it is in particular necessary in the field of the packaging of goods which perish quickly, such as meat products, sausage products or cheese products, to package these goods as hygienically, quickly and economically as possible. It is namely common practice to sell food products packaged in sliced form for a more convenient direct usability by a consumer. For this purpose, systems are generally known which comprise at least one slicing apparatus and at least one packaging apparatus in order to slice and/or package the food products in a largely automated manner. Process speeds of more than 1000 cuts per minute can in particular be achieved in this respect if the slicing apparatus is a high-speed slicer. The throughput can even be increased further by the parallel use of a plurality of slicing apparatus. This throughput then has to be packaged.

As a rule, slices cut off from a respective food product are not packaged individually, but in portions. A portion comprises at least one piece or one slice of a product. Pieces and/or slices of different products can also be combined to form a portion.

The spatial arrangement in which the respective portions are arranged with respect to one another and/or the manner in which they should be layered can furthermore be predefined. It is thereby possible to form portions whose pieces or slices can be stacked or overlapped with or without a separating sheet; in a single layer or in multiple layers; in a smooth, folded, wavy or curled manner; and in a linear, round, oval or other shape.

After such portions are formed, they can be fed to the packaging apparatus where they are then packaged. However, the portions can generally also (partly or completely) be formed directly in the packaging.

Robots having portion grippers can be used to pick up and move food products and to form such portions such as sausage, ham, cheese, meat, pasta and baked goods or the like. Such machines are, for example, so-called "pickers" which are also called "pick and place robots" or "delta robots". However, other robot types can also be used. A feed of the portions to be packaged by means of other conveying systems, e.g. belt systems, is also known.

It is a basic requirement for packaging machines to be able to quickly switch to a different product or a different packaging if required. In addition, consumed packaging material has to be refillable quickly and simply to ensure a high product throughput. The processing process of the food product, from the slicing up to the completely packaged product, should furthermore include as little human influence as possible for hygienic considerations.

A plurality of different types of packaging machines are generally known. For example, a first part of the packaging, for instance a so-called bottom film, is first fed to the packaging machine and serves as a placement unit for the food portions to be packaged. The bottom film subsequently passes through a molding region in which trays are molded in the bottom film, the food portions being placed into said trays in a further step. Finally, a second part of the packaging, for instance a so-called top film, by which the trays of the bottom film are closed or sealed is fed to the packaging machine. The top film typically has a print whose dimensioning agrees with the dimensions of the trays of the bottom film. Care must therefore be taken that the top film is coupled to the bottom film with an exact fit.

Packaging machines frequently have unwinding apparatus for the bottom and top films which are typically wound onto supply rolls. The cores of these supply rolls are supported at axles or reception shafts such that the film webs can be unwound from the rolls via mechanical apparatus.

A specific tensile stress has to be exerted on the films during the unwinding so that the top film can be connected to the bottom film in a crease-free, tight manner and above all with an exact fit. The connection of the two packaging parts with an exact fit is in particular important when the top film has a print which matches the packaging format of the trays of the bottom film. The drawing forward of the films, in particular of the bottom film, takes place by a conveying device, e.g. by a chain conveyor. Conventionally, the desired tensile stress is usually produced by braking systems which either hold back the films directly or with the aid of brake shoes which brake supply rolls. The tensile stress can also be controlled by so-called dancer systems.

Such braking or dancer systems are mechanically complex. Due to their many individual components, they are not only cost-intensive and complex to clean, they also take up a correspondingly great deal of space in the packaging machine. In addition, a high demand in effort and cost arises for which correspondingly trained personnel is necessary when, for example, a film has to be changed. The new film then namely has to be "threaded" into these systems.

It is therefore an object of the invention to provide an apparatus for packaging objects, in particular food portions, which has a design that is as simple as possible and which can simultaneously be operated as automatically as possible to largely minimize intervention by the operating personnel.

This object is satisfied by an apparatus having the features of claim 1. In accordance with the invention, the first reception shaft can be driven by means of a first drive motor to carry out a rotational movement and/or the second reception shaft can be driven by means of a second drive motor to carry out a rotational movement. In this respect, the first and/or second drive motor is/are in particular a servomotor or servomotors. In other words, a respective separate drive motor can therefore be associated with both reception shafts—or also only with one thereof. Said drive motors set the respective shaft and thus also the supply rolls placed thereat into a rotational movement, whereby the corresponding packaging material web can be unwound from the respective supply roll in a controlled manner. To draw the first web to the front in the transport direction, it is transported by the conveying device. The necessary tensile stress for a suitable strain of the bottom film can be generated by an operation of the first drive motor which is coordinated with the drawing forward of the first material web. If the top film is coupled to the bottom film, it is also drawn in the transport direction by the conveying device, while the second drive motor drives or brakes the corresponding supply roll to unwind the top film from its supply roll. It is also generally conceivable to couple the top film directly to the conveying device to transport it in the transport direction.

The necessary tensile stress can be generated directly by the respective drive motor in accordance with the invention. For this purpose, the corresponding drive motor simply drives the reception shaft faster or more slowly and thus enables a faster or slower unwinding of the corresponding film, while the conveying device (which, for example, comprises a chain drive, a band drive, a belt drive or a linear drive) draws the films in the transport direction. The corresponding drive motor is, for example, operated slightly more slowly than the conveying device or is even braked (slightly) to increase the tensile stress. Complex and/or expensive mechanical systems for unwinding and braking the films, such as dancer systems or brakes, can be dispensed with by the drive motors which can be actively operated. In addition, the conveying device is relieved of stress. Due to a need-based (active) driving of one of the two supply rolls or of both supply rolls, the conveying device namely no longer solely has to apply the force required for unwinding the web(s).

Further embodiments of the invention are set forth in the claims, in the description and in the enclosed drawing.

In accordance with an embodiment, the first and/or second drive motor directly drive(s) the respective reception shaft. The first and/or second drive motor is/are in particular integrated into the respective reception shaft. The number of individual components in the packaging machine can be reduced further by a direct drive without a transmission, whereby a more compact and simpler design can be implemented overall. In addition, the drive motors can thus be directly integrated into the reception shafts which are anyway already present. The system design in accordance with the invention can nevertheless also be implemented by an indirect drive, for example, via a transmission or a toothed belt.

In accordance with a further embodiment, the packaging apparatus comprises a control device which is configured to detect and/or to control a movement of the first and/or second drive motor, in particular in dependence on one or more operating parameters of the conveying device.

Due to configuration of the drive motors as servomotors, it is in particular possible to determine and to monitor the instantaneous positions and movements of the motors by way of the control. Depending on the film type, both the drawing forward and the film strain can thus be individually set in a flexible manner—as required. The strain can, for example, be set as constant on the rolling off during the drawing forward—or even also when the film web is stationary. In contrast, it is also possible for the strain to be variably set during the drawing forward. The control device can take over this flexible setting for all the current operating states.

It is thus, for example, possible that the top film is strained more than the bottom film so that it can be sealed to the bottom film in a crease-free manner. This strain can be directly influenced via minimal speed deviations or winding deviations between the drive motors of the reception shafts. A controlled stretching of the respective films is also possible, even in a process-dependent and/or material-dependent manner.

In accordance with a further embodiment, at least one sensor, in particular an optical sensor, is provided by which a movement of the web of the first packaging material can be detected. In addition, a further sensor, in particular an optical sensor, can alternatively or additionally be provided by which a movement of the web of the second packaging material can be detected. Moreover, a further sensor can alternatively or additionally be provided by which a mechanical strain of the web of the first and/or second packaging material can be detected. Due to the (optical) detection of the movement of the film webs, the control can recognize the position of the webs independently of the drive of the supply rolls or of the movement of the conveying device. The control can thereby inter alia detect possible errors in the drawing forward of the films. It can thus also be avoided that the two film webs are indeed sealed to one another under the correct strain, but not with an exact fit. The sensors therefore serve the additional control.

In accordance with a further embodiment, the control device is configured to control the second drive motor in dependence on a drive of a first conveying unit of the first conveying device or on an operating parameter of the drive of the first conveying unit, in dependence on the movement of the first drive motor, on the movement of the web of the first and/or second packaging material and/or on the mechanical strain of the web of the first and/or second packaging material. Due to the optical detection of the movement of the film webs—if provided—the control device can, for example, ensure that the two film webs are brought into alignment with one another such that a print of the top film correctly comes to lie on the tray of the bottom film. The first drive motor can for this purpose be driven by the control device in dependence on the movement of the second drive motor. The film web of the top film can thereby be applied to the film web of the bottom film in a direct manner and under a correct strain. The strain of the webs can in this respect also be detected by a sensor in each case.

In accordance with a further embodiment, the packaging apparatus has a molding station for molding placement elements for the reception of objects, in particular depressions or trays, in the web of the first packaging material. The molding station is in particular a deep-drawing station. The molding station is preferably arranged in front of a feed point at which the web of the second packaging material is fed to the web of the first packaging material by the feed device.

It is furthermore possible that the packaging apparatus has a sealing station which is arranged behind the feed point in the transport direction and by means of which the two webs are at least sectionally connectable to one another. Placement elements of the web of the first packaging material provided for the reception of the objects can in particular be sealed there by the web of the second packaging material. The sealing station is, for example, configured such that the bottom film can be permanently connected to the top film to reliably protect the foods present in the trays against external influences.

In accordance with an embodiment, the control device is configured to control the first drive motor in dependence on the mechanical strain of the web of the first packaging material, and/or in dependence on a cycle of a molding station and/or of a sealing station, and/or in dependence on a movement of coupling means which can be brought into engagement with the web of the first packaging material and which are drive-effectively coupled or couplable to a conveying unit, in particular to a chain drive, a band drive, a belt drive or a linear drive, of the conveying device, and/or in dependence on an operating parameter of the conveying unit. Both the molding station and the sealing station as a rule require a conveying device operated in a clocked manner. A rest phase of the conveying device should therefore follow a drawing forward phase of the material webs. Depressions can thus, for example, be molded in the first packaging material in a molding region of the molding station in the rest phase and are drawn out of said first packaging material in the following drawing forward phase. Analog to this, the sealing station conventionally also works on the closing of the packaging. The same applies to a filling of the regions (e.g. the depressions or trays) provided for the reception of the portions. Such a filling station is expediently arranged behind the molding station and in front of the sealing station in the transport direction. It is pointed out here that the features and measures in accordance with the invention can also be applied to so-called tray sealers. In such tray sealers, trays which are already complete are supplied and are closed by a top film in a sealing station. In this case, the web of the first packaging material is a continuous stream of such trays which are in particular connected to one another or coupled to one another.

Provision can generally be made that the control device operates the first drive motor in dependence on the strain of the first material web. If the above-described sensors, for example, detect that the first packaging material is not under a correct strain, the drive motor can accelerate or decelerate the unwinding of the corresponding supply roll to tension the film web again as required.

It is furthermore also conceivable that the control device drives the first drive motor in dependence on the movement of coupling means. The coupling means are conventionally used in chain drives, band drives, belt drives or linear drives and serve to securely hold the film webs. A movement of the conveying unit is converted into a movement of the first material web by a coupling of the coupling means to at least one conveying unit of the conveying device. It would consequently also be conceivable that the movement of precisely these coupling means is detected—as representative of or in addition to the movement of the conveying device—and that the drive motor of the first supply roll is operated in dependence on this detected movement.

In addition, it is optionally also possible that the first drive motor is controlled in dependence on an operating parameter of the conveying unit. A known operating parameter of the conveying unit, in particular of a motor of the conveying unit, can be representative of the movement of the conveying device or of the first material web.

Furthermore, a method is provided in accordance with the invention, in particular a method of operating a packaging apparatus in accordance with any one of the above-described embodiments, in which a movement parameter of the web of the first packaging material and/or an operating parameter of the first drive motor, a movement parameter of the web of the second packaging material and/or a mechanical strain of the web of the first packaging material is/are detected and the second drive motor is operated in dependence on the detected parameter and/or on the detected strain. To be able to connect the webs of the first and second packaging materials to one another with an exact fit, the packaging machine is therefore in other words operated such that the second drive motor, which drives the reception shaft of the second supply roll of the second packaging material to carry out a rotational movement, is controlled in dependence on one or various detected parameters. Such parameters may be the above-described movement or operating parameters of the different components of the packaging machine. It can thus, for example, be sensible if the second drive motor is operated in dependence on a detected movement parameter of the first drive motor so that the unwinding of the two film webs can take place in a mutually coordinated manner.

In accordance with an embodiment of the method, a mechanical strain of the web of the first packaging material and/or a movement parameter of coupling means which can be brought into engagement with the web of the first packaging material and which are drive-effectively coupled or couplable to a conveying unit, in particular to a chain drive, a band drive, a belt drive or a linear drive, of the conveying device and/or a movement parameter of the conveying unit is/are detected and the first drive motor is operated in dependence on the detected parameter and/or on the detected strain. Additionally or alternatively, the first drive motor is operated in dependence on a—predetermined or detected—cycle of a molding station, of a filling station and/or of a sealing station. The operation of the first drive motor can therefore also depend on different parameters. It is inter alia, for example, conceivable that the movement of the coupling means already described above is detected. The reception shaft of the first supply roll can subsequently be driven in dependence on this detected movement so that the first packaging material wound thereon can be unwound again at a speed corresponding to the detected movement. Alternatively or additionally, the first drive motor can also be controlled in dependence on other parameters such as on the mechanical strain of the web of the first packaging material and/or on a movement parameter of the conveying unit.

In accordance with a further embodiment of the method, the first drive motor is operated such that a predetermined mechanical strain—which is constant in time or variable in time—of the web of the first packaging material is produced; and/or the second drive motor is operated such that a predetermined mechanical strain—which is constant in time or variable in time—of the web of the second packaging material is produced.

In accordance with yet a further embodiment variant of the method, a transport of the web of the first packaging material takes place in a clocked manner. The mechanical strain of the web of the second packaging material is in particular varied during a cycle. This clocking can, for example—as already mentioned above—depend on the working principle of the sealing station, of the filling station and/or of the molding station.

The present invention furthermore comprises a method of determining a state parameter, in particular of determining a diameter of a second supply roll arranged at the second reception shaft, in which the following steps are carried out:

- operating the first or second drive motor using at least one predefined operating parameter to produce a rotational movement of the respective supply roll;
- detecting at least one movement parameter of the produced rotational movement of the respective supply roll; and
- determining the state parameter on the basis of the operating parameter and of the movement parameter.

In other words, in this method, e.g. the first (second) drive motor is operated to produce a rotational movement of the first (second) supply roll. This rotational movement is detected to determine the state parameter characteristic for the first (second) roll, e.g. its diameter, on the basis of said rotational movement.

Such a method can be used in a packaging machine in accordance with any one of the above-described embodiments. It can, for example, be carried out after the introduction of a new supply roll. Due to the determination of the diameter, it can, for example, be communicated to the user of the machine how many film webs are present at the supply roll. It is thus also possible to determine at what time a new supply roll has to be inserted. This method of determining a state parameter is in particular advantageously carried out before the film web of the second supply roll is coupled to the film web of the first supply roll.

Furthermore, a subject of the present invention is a further method of determining a state parameter of a second supply roll arranged at the second reception shaft, in particular of determining the diameter of the second supply roll. Said method provides the following steps:

- coupling the webs of the first and second packaging materials;
- operating the conveying device and/or the first drive motor using a predefined operating parameter to produce a movement of the web of the first packaging material;
- detecting at least one movement parameter of a rotational movement of the second supply roll which is thereby produced; and
- determining the state parameter on the basis of the produced movement of the web of the first packaging material and/or on the basis of the operating parameter and of the movement parameter of the second supply roll.

This method can also be used in a packaging machine in accordance with any one of the above-described embodiments. Unlike the above-described method, the two webs of the first and second packaging materials are, however, coupled to one another here. The conveying device (in particular a motor of a conveying unit of the conveying device) and/or the first drive motor is/are subsequently driven so that the first packaging material also takes along the second material web, e.g. in the transport direction, by the coupling to the second packaging material. The rotational movement of the second supply roll which is thereby produced can thus be detected and evaluated to determine the desired state parameter.

Furthermore, a subject of the present invention is yet a further method of determining a state parameter of a first supply roll arranged at the first reception shaft, in particular of determining a diameter of the first supply roll. Said method provides the following steps:

- operating the conveying device, in particular a motor of a conveying unit of the conveying device, using a predefined operating parameter to produce a movement of the web of the first packaging material;
- detecting at least one movement parameter of a rotational movement of the first supply roll which is thereby produced; and
- determining the state parameter on the basis of the produced movement of the web of the first packaging material and/or on the basis of the operating parameter and of the movement parameter of the first supply roll.

This method can also be used in a packaging machine in accordance with any one of the above-described embodiments. In this method, the first packaging material is drawn in the transport direction and the rotational movement of the first supply roll which is thereby produced is detected. The detected data can then be evaluated to determine the desired state parameter of the first supply roll.

Said methods can generally be carried out at any desired times—also during the ongoing operation—in particular if irregularities in the interaction of the drives and/or a deformation of the material webs were recognized by means of the control device.

The idea underlying these methods is the controlled driving of the first or second supply roll—either directly by the first or second drive motor or indirectly via a drawing at the first or second material web—and the analysis of the rotational movement of the corresponding supply roll which is thereby produced. This namely ultimately depends on the inertia of the roll and thus on its diameter, among other things. In simplified terms, there is a simple physical connection between the input variable "roll drive" and the output variable "reaction of the supply roll". These two variables are inter alia linked to one another via the inertia of the supply roll which is in turn a measure for its diameter and thus the length of the packaging material which is still present. The knowledge of this value enables an optimized and anticipatory operation of the packaging apparatus.

In accordance with an embodiment, the operating parameter is an angular increment, a torque, a frequency, an operating current or an operating voltage of the first and/or second drive motor. Additionally or alternatively, the movement parameter is position information, angular increment information, a torque, a frequency, an angular speed or an angular acceleration of the rotational movement of the first or second supply roll.

Provision can be made that a rotational speed of the first and/or second supply roll is detected, with this detection taking place by means of at least one contacting and/or contactless sensor. The detection can take place in a region close to the corresponding supply roll, for example in a section just behind a film dispensing region of the corresponding roll. Instantaneous values of the rotational speed and/or rotational speed values averaged in time can generally be detected.

It is furthermore possible to detect a movement speed of the web of the first packaging material and/or a movement speed of the web of the second packaging material and/or a movement speed of both webs in a coupled state. Instantaneous values of the movement speed and/or values of the movement speed which are averaged in time can also generally be detected here.

In accordance with an embodiment of the method, a stretching of the web of the first packaging material and/or a stretching of the web of the second packaging material can be determined on the basis of the detected movement speed of the first and/or second web and/or on the basis of the detected rotational speed.

The invention will be described in the following by way of example with reference to an advantageous embodiment and to the only FIGURE.

BRIEF DESCRIPTION OF THE DRAWING

FIG. 1 illustrates a packaging apparatus in accordance with one aspect of the disclosure.

The only FIGURE schematically shows a packaging apparatus in accordance with the invention.

The packaging apparatus in accordance with the invention comprises a conveying device 10 for transporting a continuous web 12 of a bottom film of a packaging. This bottom film 12 is unwound from a first supply roll 20 which is supported at a first reception shaft 18. This reception shaft 18 is driven by a first drive motor 26 to set the supply roll 20 into a rotational movement. The motor 26 also enables an active braking of the web 12 in a generator operation.

The conveying device 10 comprises a conveying unit 46, in particular a chain drive, a band drive, a belt drive or a linear drive. The unit 46 is (selectively) coupled to coupling means 44 which are in turn (selectively) in engagement with the film web 12 of the first packaging material. The film web 12 is thus securely held by the means 44 and drawn to the left in the FIGURE by the unit 46 in the transport direction TR of the conveying device 10.

The film web 12 first passes through a deep-drawing station 38 in which placement elements—typically depressions or trays—are molded in the film web 12 by a deep-drawing process. Subsequently, the film web 12 is transported further into a filling region (not shown) in which the food portions to be packaged are placed into the trays.

A feed point Z at which the second film web 16 is fed is present behind the filling region viewed in the transport direction TR. The second film web 16 is unwound from a supply roll 24 which is supported at a reception shaft 22. The reception shaft 22, like the reception shaft 18 of the first roll 20, is directly driven by a drive motor 28 and is set into a rotational movement.

A deflection roller, not shown here, can be provided at the feed point Z to deflect the second film web 16 in the transport direction TR. The two film webs 12, 16 are transported in parallel from here in the direction of a sealing station 42 where they are connected or sealed to one another.

A plurality of sensors 32, 34, 36 are provided so that the two film webs 12, 16 can be applied to one another with an exact fit. The sensor 32 is in this respect arranged in the region of the first film web 12. It is preferably an optical sensor by which the movement of the film web 12 can be detected, for example. The sensor 34 is arranged in the region of the second film web 16 to detect the movement of this film web 16, preferably using optical methods. The sensors 32, 34 can also be tensile stress sensors. The sensor 36 can, in contrast, be arranged in the region behind the feed point Z so that it can determine the movement and/or the mechanical strain of both film webs 12, 16.

The control device 30 can control and individually drive the two drive motors 26, 28 in dependence on these determined data. It can thereby be ensured that the film webs 12, 16 can be unwound from their supply rolls 20, 24 in a correspondingly controlled manner so that they can be sealed to one another with an exact fit. The motors 26, 28 also permit a braking of the films 12, 16. Mechanical braking systems and/or dancer systems for the setting of the tensile stress acting on the films 12, 16 can be omitted.

The invention claimed is:

1. A method of operating a packaging apparatus for packaging food portions, having a conveying device for transporting a continuous web of a first packaging material comprising a bottom film, in a transport direction; and having a feed device for feeding a continuous web of a second packaging material comprising a top film, in the transport direction, wherein the conveying device comprises a first reception shaft for receiving a first supply roll of the first packaging material and the feed device comprises a second reception shaft for receiving a second supply roll of the second packaging material; wherein the first reception shaft can be driven by means of a first drive motor to carry out a rotational movement; and/or wherein the second reception shaft can be driven by means of a second drive motor to carry out a rotational movement, with the first and/or second drive motor being a servomotor or servomotors, wherein the following steps are carried out to determine a state parameter of the second supply roll arranged at the second reception shaft, wherein the state parameter is a diameter of the second supply roll:

coupling the webs of the first and second packaging materials;

operating the conveying device and/or the first drive motor using a predefined operating parameter to produce a movement of the web of the first packaging material;

detecting at least one movement parameter of a rotational movement of the second supply roll; and determining the state parameter on the basis of the produced movement of the web of the first packaging material and/or on the basis of the operating parameter and of the movement parameter of the second supply roll.

2. The method in accordance with claim 1, wherein the first drive motor is operated such that a predetermined mechanical strain—which is constant in time or variable in time—of the web of the first packaging material is produced; and/or wherein the second drive motor is operated such that a predetermined mechanical strain—which is constant in time or variable in time—of the web of the second packaging material is produced, and/or wherein a transport of the web of the first packaging material takes place in a clocked manner; and/or wherein the following steps are carried out to determine a state parameter of a supply roll arranged at the first or second reception shaft:

operating the first or second drive motor using at least one predetermined operating parameter to produce a rotational movement of the respective supply roll;

detecting at least one movement parameter of the produced rotational movement of the respective supply roll; and determining the state parameter on the basis of the operating parameter and of the movement parameter; and/or wherein the following steps are carried out to determine a state parameter of a second supply roll arranged at the second reception shaft:

coupling the webs of the first and second packaging materials;

operating the conveying device and/or the first drive motor using a predefined operating parameter to produce a movement of the web of the first packaging material;

detecting at least one movement parameter of a rotational movement of the second supply roll which is thereby produced; and determining the state parameter on the basis of the produced movement of the web of the first packaging material and/or on the basis of the operating parameter and of the movement parameter of the second supply roll; and/or wherein the following steps are carried out to determine a state parameter of a first supply roll arranged at the first reception shaft:

operating the conveying device using a predefined operating parameter to produce a movement of the web of the first packaging material;

detecting at least one movement parameter of a rotational movement of the first supply roll which is thereby produced; and determining the state parameter on the basis of the produced movement of the web of the first packaging material and/or on the basis of the operating parameter and of the movement parameter of the first supply roll; and/or wherein a rotational speed of the first and/or second supply roll is detected, with this detection taking place by means of at least one contacting and/or contactless sensor and/or a stretching of the web of the second packaging material is/are determined on the basis of the detected movement speed of the first and/or second web and/or on the basis of the detected rotational speed; and/or wherein a movement speed of the web of the first packaging material and/or a movement speed of the web of the second packaging material and/or a movement speed of both webs in a coupled state is/are detected, and/or wherein a stretching of the web of the first packaging material and/or a stretching of the web of the second packaging material is/are determined on the basis of the detected movement speed of the first and/or second web and/or on the basis of the detected rotational speed.

* * * * *